US006412362B1

(12) United States Patent
Leung

(10) Patent No.: US 6,412,362 B1
(45) Date of Patent: Jul. 2, 2002

(54) TOY GEARING SYSTEM

(75) Inventor: Shu-Wa Leung, Hong Kong (HK)

(73) Assignee: Hop Lee Cheong Industrial Company Limited, Hong Kong (HK)

( * ) Notice: Subject to any disclaimer, the term of this patent is extended or adjusted under 35 U.S.C. 154(b) by 0 days.

(21) Appl. No.: 09/480,746

(22) Filed: Jan. 10, 2000

(51) Int. Cl.[7] ..... A63H 33/06
(52) U.S. Cl. ..... 74/413; 446/90; 446/118
(58) Field of Search ..... 74/413, 416, 421 A, 74/421 R, 606 R; 446/90, 103, 102, 118; D21/475

(56) References Cited

U.S. PATENT DOCUMENTS

| | | | | | |
|---|---|---|---|---|---|
| 3,193,293 | A | * | 7/1965 | Schaper | 446/103 X |
| 3,608,233 | A | * | 9/1971 | Aoki | 446/90 |
| 4,507,095 | A | * | 3/1985 | Lin | 446/118 |
| 5,194,031 | A | * | 3/1993 | Sahler | 74/421 R X |
| 5,779,515 | A | * | 7/1998 | Chung | 446/90 |
| D405,480 | S | * | 2/1999 | Yamazaki | D21/475 |

OTHER PUBLICATIONS http://www.amazon.com, Gearation Activity Set: Customer Reviews, Jul. 18, 1999, p. 2 of 3.* http://store.yahoo.com/iqkids1/gearrefmag.html, Feb. 2001.*

* cited by examiner

*Primary Examiner*—David A. Bucci
*Assistant Examiner*—Colby Hansen
(74) *Attorney, Agent, or Firm*—Alix, Yale & Ristas, LLP

(57) ABSTRACT

A toy gearing system comprising a drive unit and at least one gear unit. The drive unit comprises a body, a gearwheel supported by the body and having at least some of its teeth exposed for gear engagement, an electric motor for rotating the gearwheel and drive transmission apparatus provided between the motor and the gearwheel. The gear unit comprises a body and a gearwheel supported by the body for rotation by the gearwheel of the drive unit. The bodies are provided with respective self-attaching apparatus for attaching the drive and gear units onto a flat surface at any desired positions which are not predetermined, with the gearwheels in gear engagement for simultaneous rotation.

5 Claims, 2 Drawing Sheets

TOY GEARING SYSTEM

The present invention relates to a toy gearing system.

BACKGROUND OF THE INVENTION

The type of toy gearing systems generally known comprises a board provided with a motor-driven gearwheel and a plurality of separate gearwheels which have individual shafts for location by respective recesses of the board for rotation by the gearwheel of the board. As the recesses are formed at predetermined positions on the board, the separate gearwheels are confined to those positions and their arrangement is fairly limited. The necessity of using the board is another restriction.

The invention seeks to mitigate or at least alleviate such disadvantages by providing an improved toy gearing system.

SUMMARY OF THE INVENTION

According to the invention, there is provided a toy gearing system comprising a drive unit and at least one gear unit; said drive unit comprising a body, a gearwheel supported by the body and having at least some of its teeth exposed for gear engagement, an electric motor for rotating the gearwheel and drive transmission means provided between the motor and the gearwheel; said gear unit comprising a body and a gearwheel supported by the body for rotation by the gearwheel of the drive unit; said bodies being provided with respective self-attaching means for attaching the drive and gear units onto a flat surface at any desired positions which are not predetermined, with the gearwheels in gear engagement for simultaneous rotation.

In a preferred embodiment, the drive unit body is formed with a side slot through which at least some of the teeth of the respective gearwheel protrude out.

More preferably, the slot is part-circular and extends around the side of the drive unit body over an angle of at least 180°.

In a preferred embodiment, the gear unit body is in the form of a base supporting the respective gearwheel above it for rotation.

More preferably, the base is circular and smaller than the respective gearwheel, and the gearwheel is supported co-axially on the base such that all of its teeth protrude beyond the perimeter of the base.

It is preferred that each self-attaching means is provided by a magnetic member.

It is further preferred that the magnetic member is in the form of a sheet or tape.

Preferably, the magnetic member is affixed to the respective body by adhesive.

Preferably, the drive transmission means is provided by a speed-reduction gear train.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
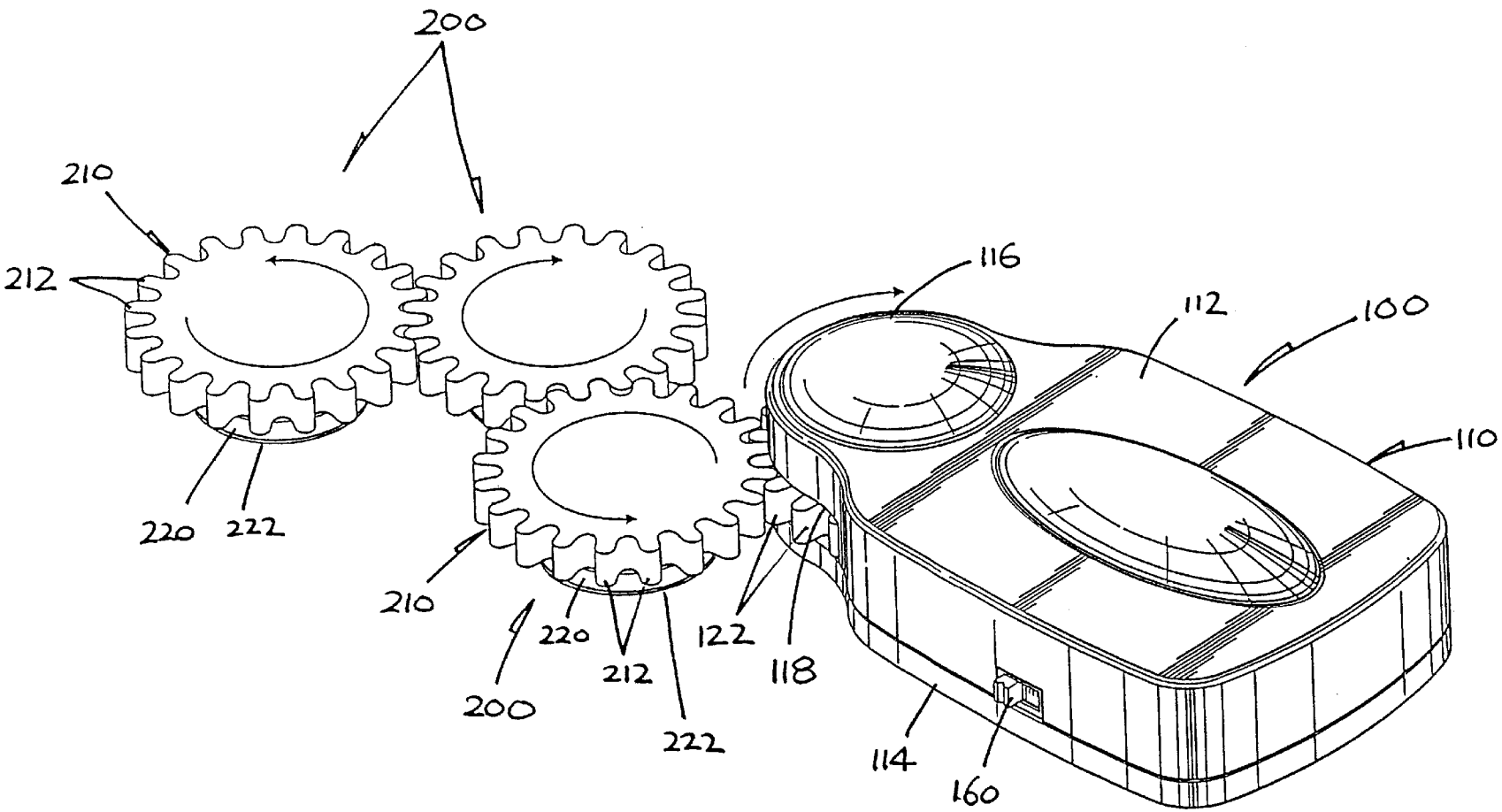
FIG. 1 is a top perspective view of an embodiment of a toy gearing system in accordance with the invention, said system having a drive unit and several gear units.
Figure 2:
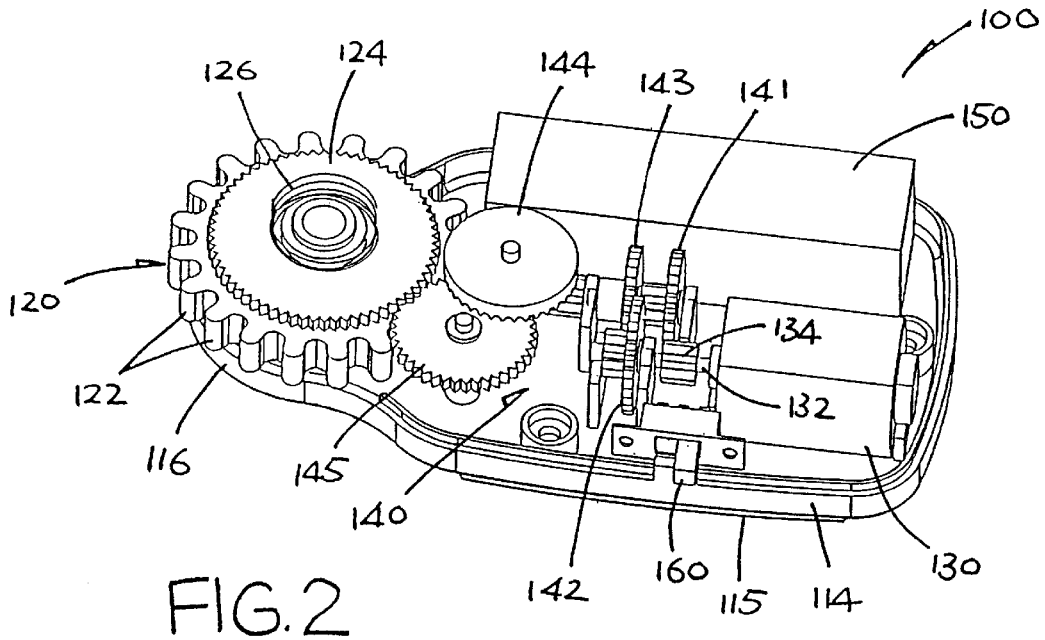
FIG. 2 is a top perspective of the drive unit of FIG. 1, shown with an upper casing removed.
Figure 3:
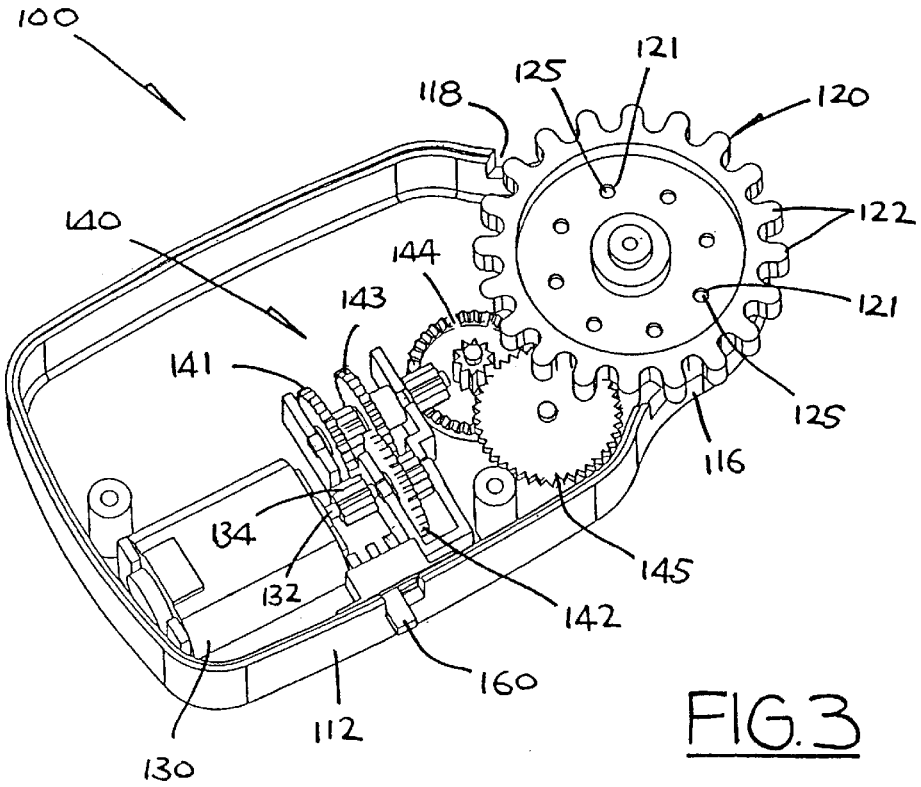
FIG. 3 is a bottom perspective of the drive unit of FIG. 1, shown with a lower casing removed.

Referring to the drawings, there is shown a toy gearing system embodying the invention, which system comprises a drive unit 100 and one or more separate gear units 200 for driving by the drive unit 100.

The drive 100 has a generally flat body 110, which is formed by upper and lower casings 112 and 114 and has a semi-circular front end 116 of a reduced size. An output gearwheel 120 is supported horizontally at the body front end 116 for rotation. The upper casing 112 is formed with an arcuate slot 118 extending around the body front end 116 over an angle of substantially or at least 180°. The gearwheel 120 is relatively larger than the body front end 116 and is sandwiched co-axially there between the casings 112 and 124 such that at least half of its teeth 122 protrude out through the slot 118 for gear engagement.

The output gearwheel 120 is provided with a co-axial clutch gearwheel 124 which is maintained in clutch engagement with the output gearwheel 120 under the action of a co-axial coil spring 126 on the opposite side. The clutch engagement is effected through engagement between a ring of small holes 121 formed in the body of the output gearwheel 120 and a ring of short posts 125 formed on the body of the clutch gearwheel 124. By reason of the clutch engagement, the output gearwheel 120 is rotatable with the clutch gearwheel 124.

A magnetic sheet (or tape) 115 is affixed to the bottom side of the lower casing 114 of the body 110, by adhesive for example, for holding the overall drive unit 100 in a stationary position on a metal surface through magnetic attraction.

The drive unit 110 includes, internally of its body 110, an electric motor 130 for driving the output gearwheel 120, a gear train 140 provided between the motor 130 and the gearwheel 120 for drive transmission, a battery compartment 150 for accommodating a battery cell to power the motor 130, and a switch 160 (operable on one side of the body 110) for switching on and off the motor 130. The motor 130 has a horizontal shaft 132 provided with a co-axial pinion 134. The gear train 140 is formed by, in the direction of drive transmission, a series of three vertical speed-reduction pinion/gearwheels 141 to 143, a horizontal speed-reduction crown pinion/gearwheel 144 changing the angle of drive transmission through an angle of 90°, and a horizontal plain gearwheel 145 at the end.

The first and the end gearwheels 141 and 145 are in mesh with the motor pinion 132 and the clutch gearwheel 124 respectively, such that the motor 130 will upon energization rotate the output gearwheel 120 at a slow speed.

Referring to the gear units 200, each of them has a horizontal gearwheel 210 and a circular base 220 supporting the gearwheel co-axially above it for free rotation. The gearwheel 210 is relatively larger than the base 220 such that all of its teeth 212 protrude beyond the perimeter of the base 220. The bottom side of the base 220 is provided with a magnetic sheet (or tape) 222, affixed thereto by adhesive for example, for holding the overall gear unit 200 in a stationary position on a metal surface through magnetic attraction.

The toy gearing system is intended to be played on a flat metal surface, which may be horizontal such as a desk top or vertical such as the door of a refrigerator, or any ferromagnetic surface. In operation, the drive and gear units 100 and 200 are attached onto the metal surface to build a gearwork, with the gearwheels 210 of the respective gear units 200 meshing with one another to form a gear train having an end in turn meshing with the gearwheel 120 of the drive unit 100 for simultaneous rotation. Upon being switched on by means of the switch 160, the drive unit 100 will drive all the gear units 200, causing their gearwheels 210 to rotate at the same time. The gear units 200 may be connected into more than one gear train for simultaneous action by the drive unit 100. Each gear train may extend out in a series and/or like branches, adding playing fun and creativity.

It is possible that the gear train 140 of the drive unit 100 may be replaced by or include a drive transmission belt, or any other equivalent means.

It is envisaged that the drive and gear units 100 and 200 may be attached onto the flat surface by any self-attaching means other than magnetic members. For example, if the magnetic sheets 115 and 222 are replaced by suction cups, the drive and gear units 100 and 200 may be played on any flat surface that is being attachable by suction. It will also work if the drive and gear units 100 and 200 and the flat surface are provided with inter-attachable hook-and-loop fastening tapes.

The essence of the toy gearing system is that the gear units 200 may be placed at any desired or random positions, which are not predetermined, relative to the drive unit 100 for building a gearwork.

The invention has been described by way of example only, and various other modifications of and/or alternations to the described embodiment may be made by persons skilled in the art without departing from the scope of the invention as specified in the appended claims.

What is claimed is:

1. A toy gearing system comprising:

a drive unit, said drive unit comprising an elongated body having symmetrical lateral sides and having a curvilinear nose shaped portion at one axial extremity, said curvilinear nose shaped portion having symmetrical generally arcuate side slots through which at least some of the teeth of the respective gearwheel protrude, said side slots collectively defining a single slot that is generally arcuate and extends around the curvilinear nose shaped portion over an angle of at least 180° and a first gearwheel supported by the body, said gearwheel comprising gear teeth wherein teeth disposed on at least 180° of the angular extent of said first gearwheel extend radially beyond said curvilinear nose shaped portion and are exposed for gear engagement, the drive unit further including an electric motor for rotating the first gearwheel and a drive transmission means provided between the motor and the first gearwheel; and a gear unit comprising a second body and a second gearwheel supported by the second body for rotation by the first gearwheel of the drive unit, said second body being in the form of a base supporting the second gearwheel above it for rotation, the base being circular and smaller than the respective gearwheel, and the gearwheel is supported co-axially on the base such that all of its teeth protrude beyond the perimeter of the base, each of said bodies including respective self-attaching means for attaching the drive and gear units onto a flat surface at selected positions with the first and second gearwheels in meshing engagement for simultaneous rotation.

2. The toy gearing system as claimed in claim 1, wherein each self-attaching means comprises a magnetic member.

3. The toy gearing system as claimed in claim 2, wherein the magnetic member is in the form of a generally planar member.

4. The toy gearing system as claimed in claim 3, wherein the magnetic member is affixed to the respective body by adhesive.

5. The toy gearing system as claimed in claim 1, wherein the drive transmission means includes a speed-reduction gear train.

* * * * *